US007274897B2

(12) United States Patent
Katoh

(10) Patent No.: US 7,274,897 B2
(45) Date of Patent: Sep. 25, 2007

(54) IMAGE FORMING METHOD AND APPARATUS WITH A TRANSFER BELT

(75) Inventor: Tsutomu Katoh, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/020,465

(22) Filed: Dec. 27, 2004

(65) Prior Publication Data

US 2005/0169667 A1 Aug. 4, 2005

(30) Foreign Application Priority Data

Dec. 26, 2003 (JP) ..... 2003-433199

(51) Int. Cl.
*G03G 15/16* (2006.01)

(52) U.S. Cl. ..... 399/121; 399/110

(58) Field of Classification Search ..... 399/121, 399/111, 110, 107, 124
See application file for complete search history.

(56) References Cited

U.S. PATENT DOCUMENTS

| | | | | |
|---|---|---|---|---|
| 5,950,062 | A | 9/1999 | Yahata et al. | 399/358 |
| 6,097,913 | A * | 8/2000 | Bertram et al. | 399/121 |
| 6,928,251 | B2 * | 8/2005 | Yoshihara et al. | 399/107 |
| 7,020,415 | B2 * | 3/2006 | Abe | 399/110 |
| 2004/0013446 | A1 * | 1/2004 | Morioka et al. | 399/111 |
| 2004/0101328 | A1 * | 5/2004 | Kimura et al. | 399/111 |
| 2004/0228653 | A1 * | 11/2004 | Yoshino | 399/121 |
| 2006/0284958 | A1 | 12/2006 | Saeki et al. | |

FOREIGN PATENT DOCUMENTS

| | | |
|---|---|---|
| JP | 08-137297 | 5/1996 |
| JP | 10/104998 | 4/1998 |
| JP | 10-187002 | 7/1998 |
| JP | 2002-040818 | 2/2002 |
| JP | 2003-084644 | 3/2003 |
| JP | 2003-173091 | 6/2003 |
| JP | 2003-186371 | 7/2003 |
| JP | 2004-109466 | 4/2004 |
| JP | 2004-138927 | 5/2004 |
| JP | 2004-184449 | 7/2004 |
| JP | 2004-212568 | 7/2004 |

OTHER PUBLICATIONS

U.S. Appl. No. 11/207,730, filed Aug. 22, 2005, Sawai, et al.
U.S. Appl. No. 11/608,008, filed Dec. 7, 2006, Katoh, et al.
U.S. Appl. No. 11/608,175, filed Dec. 7, 2006, Kuma, et al.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes a transfer belt unit configured to be detachable from a housing. The transfer belt includes at least two support rollers and at least one frame member configured to rotatably support the at least two support rollers. The frame member includes a front frame having a flexible member having a free edge configured to be engaged with the housing. A belt is extended by the at least two support rollers. A locking member is configured to lock the front frame and the housing by coupling the free edge of the flexible member to the housing.

27 Claims, 8 Drawing Sheets

IMAGE FORMING METHOD AND APPARATUS WITH A TRANSFER BELT

BACKGROUND OF THE INVENTION (a) Field of the Invention

The present invention relates to an image forming apparatus and a transfer belt unit, and more particularly to a method of assembling a transfer belt unit of the image forming apparatus.

(b) Discussion of the Related Art

Recently, increased numbers of users have been using a full color printing function of an image forming apparatus, and they have been demanding an image forming apparatus capable of conducting full color imaging processes in a substantially same time required for monochrome imaging processes.

Accordingly, an image forming apparatus of tandem type having a plurality of photoconductive members has been developed to decrease a process time required for full color imaging processes. A typical image forming apparatus of tandem type employs a direct transfer method or an indirect transfer method.

In the direct transfer method, images formed on the each of the photoconductive members are sequentially and directly transferred to a recording sheet transported on a transfer belt unit. In the indirect transfer method, images formed on the each of the photoconductive members are sequentially transferred to an intermediate transfer member (e.g., an intermediate transfer belt) by a primary transfer unit. The images on the intermediate transfer member are then transferred to a recording sheet by a secondary transfer unit en bloc.

Typically, the primary transfer unit includes a frame, a plurality of support rollers, and a belt. The plurality of support rollers is rotatably supported by the frame, and the belt is extended by the plurality of support rollers.

The primary transfer unit is configured to be detachable from an image forming apparatus. By this arrangement, the primary transfer unit can be removed for maintenance and replaced, as required.

The primary transfer unit is detachable from the image forming apparatus by several methods, such as by attaching or detaching the primary transfer unit in an axis direction of the support rollers of the primary transfer unit, or by attaching or detaching the primary transfer unit in a direction perpendicular to an axis direction of the support rollers of the primary transfer unit, for example.

As for a typical image forming apparatus, the primary transfer unit (i.e., transfer belt unit) is detachable in an axis direction of the support rollers, the axis direction of the support rollers coinciding with the front-to-rear direction of the image forming apparatus. Therefore, attachment and detachment of the transfer belt unit to the image forming apparatus can be accomplished at the front side of the image forming apparatus, resulting in a relatively higher efficiency of attachment and detachment.

However, in such a configuration, the image forming apparatus does not have a board supporting one end of the support rollers at the front side of the image forming apparatus, because attachment and detachment of the transfer belt unit is performed from the front side of the image forming apparatus.

Such image forming apparatus can support one end of the support rollers at the rear side of the image forming apparatus, but may not support the other end of the support rollers at the front side of the image forming apparatus. Therefore, the transfer belt unit may not be accurately positioned in the image forming apparatus.

To avoid these problems, some image forming apparatuses support the transfer belt unit at both front and rear sides of the image forming apparatus. In such image forming apparatus, one side of the transfer belt unit is connected to a board at the rear side of the image forming apparatus, and the other side of the transfer belt unit is connected to a board at the front side of the image forming apparatus. Attachment and detachment of the transfer belt unit is performed in an axis direction of the support rollers of the transfer belt unit. Such configuration may increase a positional accuracy of the transfer belt unit in the image forming apparatus.

However, the above-mentioned board is made of a metal sheet having a thickness of 1 mm or more, for example, and typically, such board is not integrated with the transfer belt unit but is a separate component. Therefore, inexperienced users may experience difficulties in attachment and detachment of the transfer belt unit.

To avoid these problems, some transfer belt units are integrated with a board. However, such transfer belt units have increased weights. In addition, such transfer belt units may have increased manufacturing cost because of the integrated board, which is disfavored in the transfer belt unit that will be replaced within a specific period.

Another image forming apparatus uses a transfer belt unit having a belt and support rollers supported by a frame formed from a resinous material, and a unit housing. The unit housing encases the transfer belt unit and is then attached in the image forming apparatus.

However, such configurations are complex, resulting in an increase of manufacturing cost of the transfer belt unit. In addition, attachment and detachment between the transfer belt unit and the unit housing is required when replacing the transfer belt unit. Further, a drive roller included in the support rollers of the transfer belt unit should be securely coupled to a driving system of the image forming apparatus so that the coupling is not disconnected. To do so, an elastic member, such as a spring and/or rubber, is disposed between the board of the image forming apparatus and the transfer belt unit as a force-biasing member to force the transfer belt unit to the image forming apparatus. By this arrangement, disconnection of the drive roller and the driving system of the image forming is prevented. However, the elastic member is provided as separate component, resulting in an increase of the manufacturing cost of the transfer belt unit.

SUMMARY OF THE INVENTION

The present invention provides an image forming apparatus including a transfer belt unit configured to be detachable from a housing. The transfer belt includes at least two support rollers and at least one frame member configured to rotatably support the at least two support rollers. The frame member includes a front frame having a flexible member having a free edge configured to be engaged with the housing. A belt is extended by the at least two support rollers. A locking member is configured to lock the front frame and the housing by coupling the free edge of the flexible member to the housing.

The present invention further provides an image forming apparatus including means for transferring configured to be detachable from means for housing. The means for transferring includes at least two support rollers, at least one frame member configured to rotatably support the at least two support rollers and including a front frame having a flexible member having a free edge configured to be engaged with the housing, a belt extended by the at least two support rollers, and a locking member configured to lock the front frame and the means for housing by coupling the free edge of the flexible member to the means for housing.

The present invention still further provides a method of detachably attaching a transfer belt unit to a housing of an image forming apparatus, including inserting the transfer belt unit in the housing, positioning the transfer belt unit in the housing, and locking the transfer belt unit to the housing.

The present invention still further provides a transfer belt unit configured to detachably attach to an image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
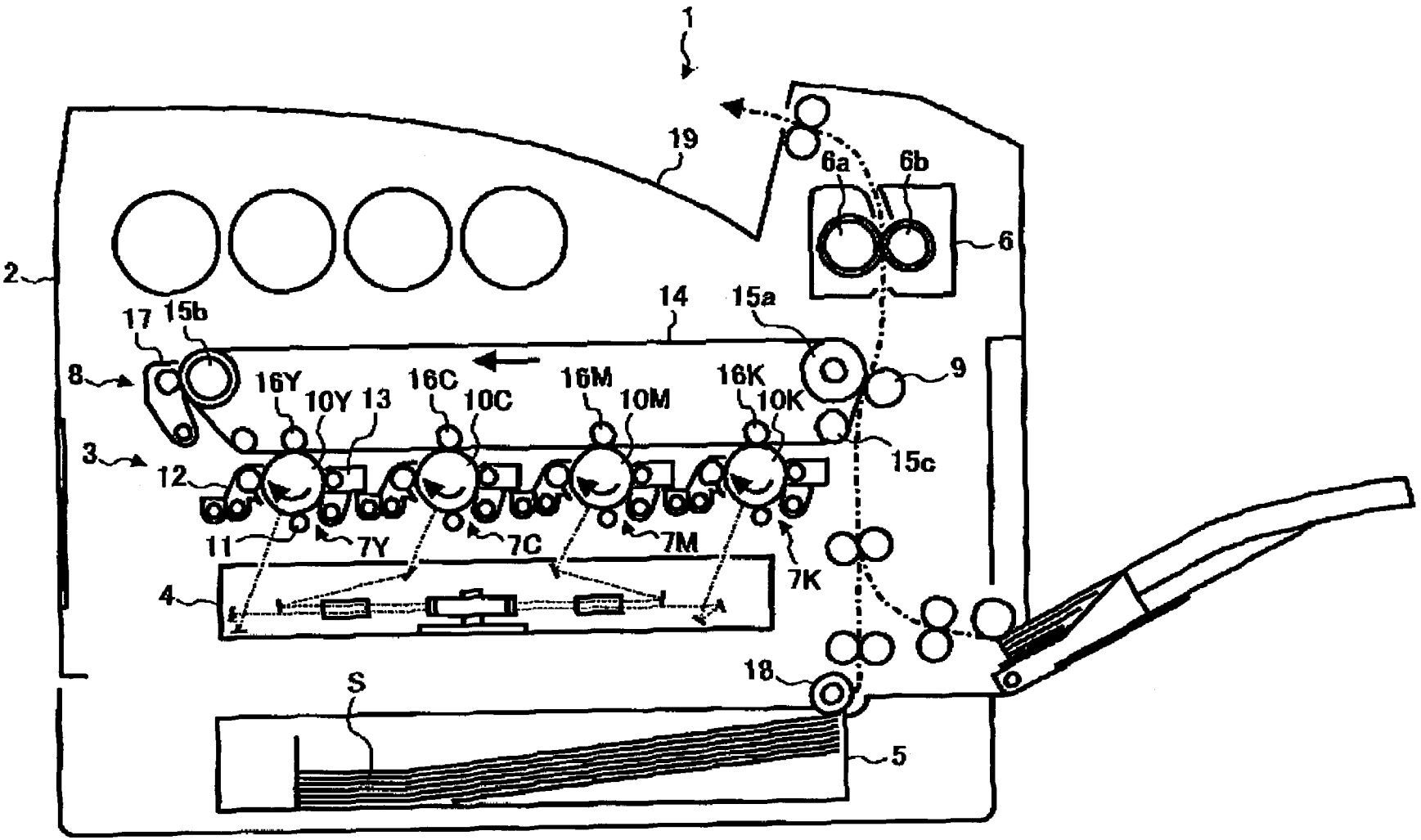
FIG. 1 is a schematic view of an image forming apparatus of tandem type according to the present invention.

In describing preferred embodiments illustrated in the drawings, specific terminology is employed for clarity. However, the disclosure of the present invention is not intended to be limited to the specific terminology so selected, and it is to be understood that each specific element includes all technical equivalents that operate in a similar manner.

Throughout the specification and drawings of the present invention, reference characters Y (yellow), M (magenta), C (cyan), and K (black) are used to refer to the color of the toner images generated by the image forming units, as required.

Referring now to the drawings, where like reference numerals designate identical or corresponding parts throughout the several views, FIGS. 1 to 4 show an image forming apparatus of tandem type and a transfer belt unit according to the present invention.

As shown in FIG. 1, an image forming apparatus 1 includes a housing 2, an image forming section 3, an optical writing unit 4, a sheet feed cassette 5 for storing recording sheets, and a fusing unit 6. The image forming section 3 includes image forming units 7Y, 7M, 7C, and 7K, where each of the image forming units 7Y, 7M, 7C, and 7K forms a toner image of yellow, cyan, magenta, and black, respectively.

A transfer belt unit 8, and a secondary transfer roller 9 are disposed above the image forming units 7Y, 7M, 7C, and 7K. Each of the image forming units 7Y, 7M, 7C, and 7K having a structure similar to one another, and includes photoconductive members 10Y, 10M, 10C, and 10K in drum shape, respectively, a charging roller 11, a developing unit 12, and a cleaning unit 13 for forming an electrostatic latent image and a toner image.

The charging roller 11, the developing unit 12, and the cleaning unit 13 are disposed at a periphery of each of the photoconductive members 10Y, 10M, 10C, and 10K rotating in the direction indicated by the arrow in FIG. 1, where each of the photoconductive members 10Y, 10M, 10C, and 10K are disposed equally spaced-apart and parallel to the adjacent photoconductive members. Each of the photoconductive members 10Y, 10M, 10C, and 10K is formed from a metal including aluminum, for example, and shaped as a cylinder with a diameter of from 30 to 100 mm, for example. A surface of each of the photoconductive members 10Y, 10M, 10C, and 10K includes a photoconductive material, such as an organic semiconductor layer, for example.

The transfer belt unit 8 includes an intermediate transfer belt 14, support rollers 15*a*, 15*b*, and 15*c*, and primary transfer rollers 16Y, 16M, 16C, and 16K. The intermediate transfer belt 14 is driven in the direction indicated by the arrow in FIG. 1 while extended by the support rollers 15*a*, 15*b*, and 15*c*. As shown in FIG. 1, the primary transfer rollers 16Y, 16M, 16C, and 16K are disposed on an inner surface of the intermediate transfer belt 14 to conduct an intermediate transfer. Preferably, the intermediate transfer belt 14 is formed from a resinous material or rubber having a thickness from 50 to 600 μm (i.e., from $50\times10^{-6}$ m to $600\times10^{-6}$ m), for example, and may have a resistance value capable of receiving a toner image formed on the photoconductive members 10Y, 10M, 10C, and 10K to a surface of the intermediate transfer belt 14.

At each nip position defined by the photoconductive members 10Y, 10M, 10C, and 10K and the primary transfer rollers 16Y, 16M, 16C, and 16K disposed along the intermediate transfer belt 14, the primary transfer rollers 16Y, 16M, 16C, and 16K conduct an intermediate transfer, in which the toner images are transferred from the photoconductive members 10Y, 10M, 10C, and 10K to the intermediate transfer belt 14.

The support roller 15*a* is coupled to a driving system (not shown) of the image forming apparatus and rotated by the driving system to drive the intermediate transfer belt 14 in the direction indicated by the arrow in FIG. 1. Hereafter, the support roller 15*a* is referred as a driving support roller 15*a*. At one side of the transfer belt unit 8 is disposed a cleaning device 17 for cleaning a surface of the intermediate transfer belt 14.

As shown in FIG. 1, the optical writing unit 4 disposed below the image forming units 7Y, 7M, 7C, and 7K emits respective laser beams corresponding to Y, M, C, and K. Each of the respective laser beams irradiates a surface of the photoconductive members 10Y, 10M, 10C, and 10K to form an electrostatic latent image on the surface of the photoconductive members 10Y, 10M, 10C, and 10K.

A slit (not shown) is provided between the charging roller 11 and the developing unit 12 to allow a passage of the laser beam emitted from the optical writing unit 4.

In FIG. 1, the optical writing unit 4 uses a laser-scanning method including a laser beam source, and a polygon mirror. It is to be understood, however, that the optical writing unit 4 can use an LED (light emitting diode) array method having a plurality of LEDs and focus devices.

As shown in FIG. 1, recording sheets S are stacked and stored in the sheet feed cassette 5, and fed out one by one from the sheet feed cassette 5 by a sheet feed roller 18.

As shown in FIG. 1, the fusing unit 6 includes a fusing roller 6*a* and a pressure roller 6*b*. The fusing unit 6 applies heat and pressure to a toner image on the recording sheet S to fix the toner image on the recording sheet S.

A series of image forming processes conducted in the image forming apparatus 1 is summarized below.

A semiconductor laser in the optical writing unit 4 emits laser beams corresponding to original image data. The laser beam irradiates a surface of the photoconductive members 10Y, 10M, 10C, and 10K, which are charged in advance, to form an electrostatic latent image on the surface of the photoconductive members 10Y, 10M, 10C, and 10K.

The developing unit 12 supplies respective toners to the surface of the photoconductive members 10Y, 10M, 10C, and 10K to make visible the electrostatic latent image as a toner image.

With a transferring effect of the primary transfer rollers 16Y, 16M, 16C, and 16K, the toner image is sequentially transferred to an outer surface of the intermediate transfer belt 14 driven synchronously with the photoconductive members 10Y, 10M, 10C, and 10K. Thus, the respective toner images formed on the photoconductive members 10Y, 10M, 10C, and 10K are sequentially overlayed and transferred on the outer surface of the intermediate transfer belt 14 to form a full color toner image on the intermediate transfer belt 14.

With a transferring effect of the secondary transfer roller 9, the full color toner image on the intermediate transfer belt 14 is transferred to the recording sheet S, fed from the sheet feed cassette 5, at a nip position defined by the secondary transfer roller 9 and the intermediate transfer belt 14.

The recording sheet S having the full color toner image thereon is processed by the fusing unit 6 to fix the full color toner image on the recording sheet S. After fixing the full color toner image on the recording sheet S, the recording sheet S is ejected to a sheet ejection tray 19 provided on an upper surface of the housing 2.

Figure 2:
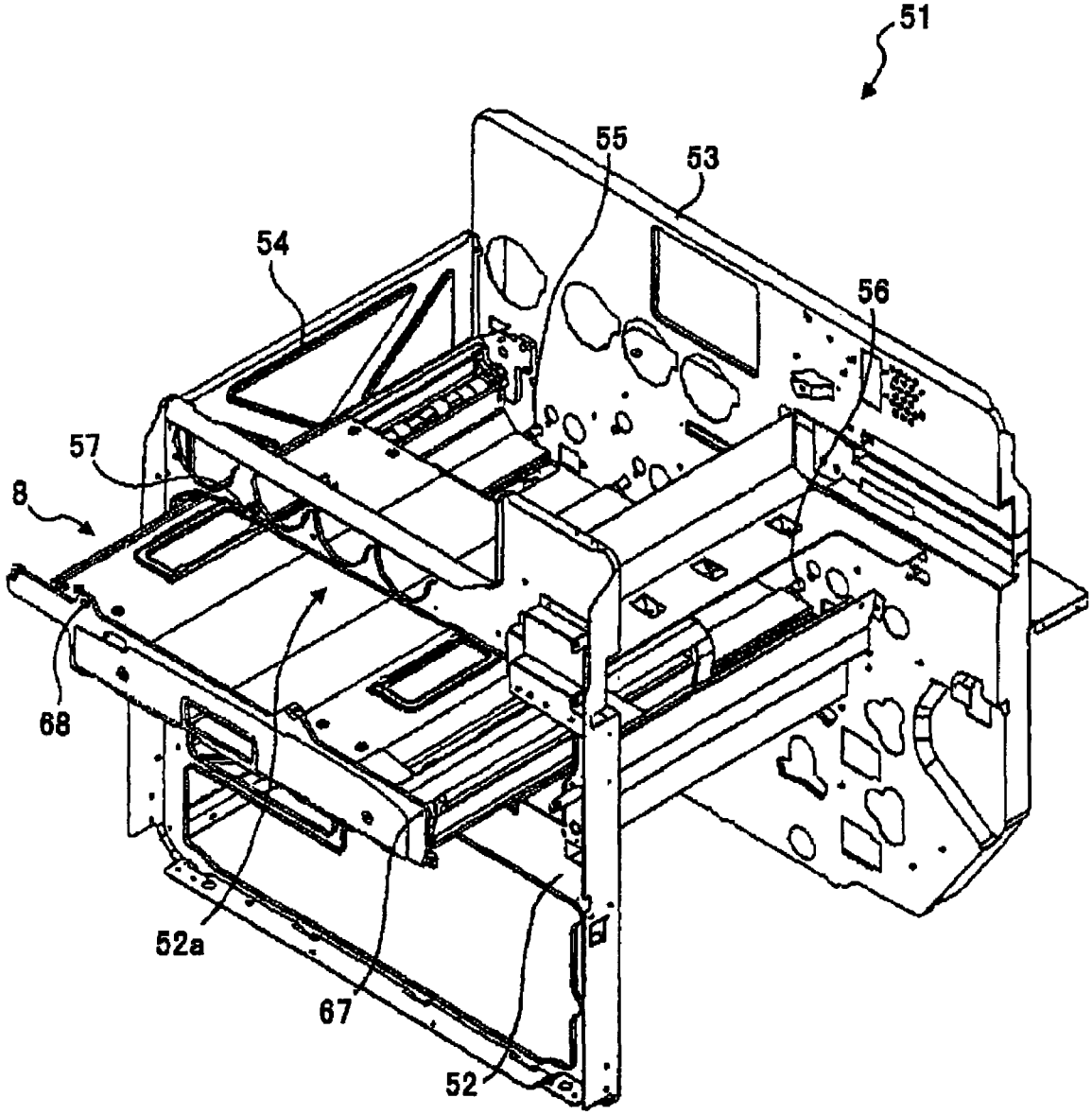
FIG. 2 is a perspective view of an internal structure of an image forming apparatus according to the present invention.

The transfer belt unit 8 according to the present invention is explained below with reference to FIGS. 2 to 4.

For simplicity, illustration of the intermediate transfer belt 14 is omitted in FIGS. 2 to 8 and FIGS. 10 to 12.

In an embodiment of the present invention, the transfer belt unit 8 is detachably provided to the housing 2. As shown in FIG. 2, the housing 2 includes a housing frame 51 and an exterior member (not shown) coupled to an outer periphery of the housing frame 51. A door (not shown) provided on a front side of the housing 2 allows an access to an inner space of the housing 2. The housing frame 51 includes a front frame 52, a rear frame 53, and a coupling member 54 coupling the front frame 52 and the rear frame 53. The front frame 52 includes an opening 52*a* allowing a movement of the transfer belt unit 8 to the front and rear side directions of the image forming apparatus.

Figure 3:
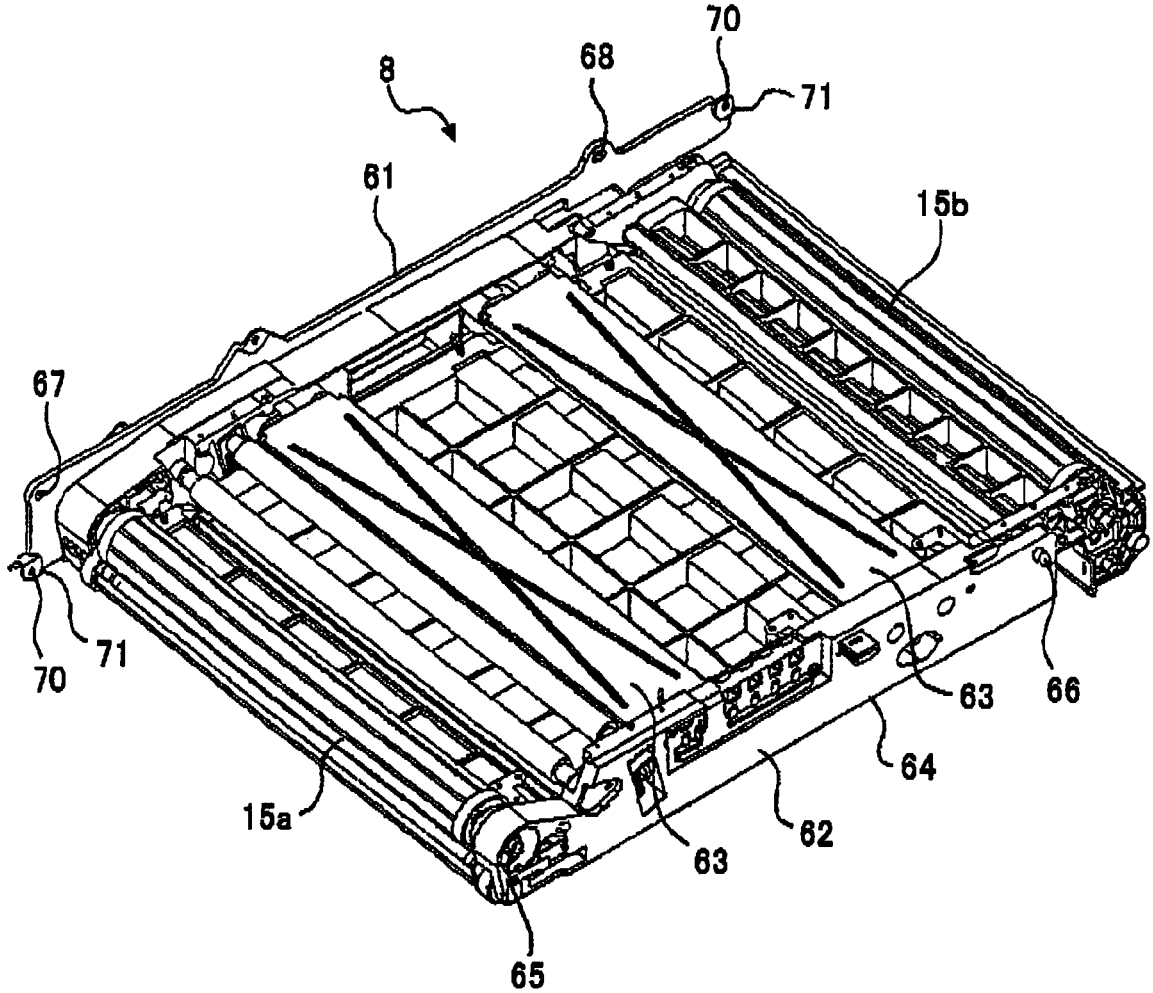
FIG. 3 is a perspective view of an intermediate transfer belt unit according to the present invention.

As shown in FIG. 3, the transfer belt unit 8 includes a front plate 61, a rear plate 62, the support rollers 15*a*, 15*b*, and 15*c*, and the primary transfer rollers 16Y, 16M, 16C, and 16K (omitted from FIG. 3).

Each end of the support rollers 15*a*, 15*b*, and 15*c* and the primary transfer rollers 16Y, 16M, 16C, and 16K is rotatably supported by either the front plate 61 or the rear plate 62.

As shown in FIG. 3, the front plate 61, the rear plate 62, and a stay member 63 which couples the front plate 61 and the rear plate 62 provide a frame 64 of the transfer belt unit 8. Preferably, the frame 64 is formed from a resinous material.

Assembly of the transfer belt unit 8 to the housing 2 is explained below.

The driving support roller 15*a* includes a roller shaft 65. One end of the roller shaft 65 at the rear plate 62 side is detachably engaged with a coupling part 56 (as shown in FIG. 2) fixedly provided on the housing 2. The rear frame 53 of the housing frame 51 is provided with a first reference hole 55, and the rear plate 62 of the frame 64 is provided with a first reference pin 66, as shown in FIG. 3. The first reference hole 55 and the first reference pin 66 are detachably engaged with each other.

The front plate 61 is provided with a second reference hole 67 and a third reference hole 68 which are used to determine a position of the transfer belt unit 8 in the housing 2. The second reference hole 67 is detachably engaged with a second reference pin (not shown) formed on the housing frame 51, and the third reference hole 68 is detachably engaged with a third reference pin 57 (as shown in FIG. 2) formed on the front frame 52 of the housing frame 51.

By this arrangement, a position of the transfer belt unit 8 in the housing 2 is determined.

As shown in FIG. 3, a flexible member 71 has a plate shape with a mounting hole 70 formed at each end of the front plate 61. As shown in FIG. 4, the flexible member 71 has a free edge 81 and is integrally formed with the front plate 61. The mounting hole 70 is formed in the free edge 81 of the flexible member 71.

A fastener 72 (i.e., a locking member), such as a screw, is inserted into the mounting hole 70, and is fastened to the front frame 52 of the housing frame 51 to fix the transfer belt unit 8 to the housing 2. Such fixing results in flexing of the flexible member 71 toward the front frame 52 as shown in FIG. 4. By this arrangement, the transfer belt unit 8 is biased toward the housing 2. As a result of the biasing, the one end of the roller shaft 65 of the driving support roller 15*a* of the transfer belt unit 8 can securely engage the coupling part 56. The transfer belt unit 8 can be detached from the housing 2 by unscrewing the screw 72.

As described above, in an embodiment of the present invention, the second reference hole 67 and the third reference hole 68 are formed in the frame 64 of the transfer belt unit 8 to determine the position of the transfer belt unit 8 in the housing 2. By this arrangement, the transfer belt unit 8 can be assembled to the housing 2 with a higher precision. In addition, a separate board, such as is included in a conventional image forming apparatus, need not be used with the present invention. Therefore, the transfer belt unit 8 can be easily attached to and detached from the image forming apparatus.

As discussed above, preferably the frame 64 is formed from a resinous material, for example. Therefore, the transfer belt unit 8 can be lighter in weight and an attachment and detachment of the transfer belt unit 8 can be more easily accomplished. Further, because the transfer belt unit 8 does not include the separate board, and the frame 64 can be made form a resinous material, the manufacturing cost of the transfer belt unit 8 can be reduced.

As discussed above, the flexible member 71 and the screw 72 biases the transfer belt unit 8 to the housing 2. Therefore, the one end of the roller shaft 65 of the driving support roller 15*a* can securely engage the coupling part 56 (see FIG. 2). By this arrangement, a separate biasing device, such as spring used in a conventional device, need not be used in the present invention. Therefore, the manufacturing cost of the transfer belt unit 8 can be reduced.

As discussed above, the transfer belt unit 8 is used as an intermediate transfer belt unit for image forming. However, the transfer belt unit 8 can be also used as a transport belt, in which a toner image formed on a photoconductive member is transferred to a recording sheet while the transfer belt unit is transporting the recording sheet thereon.

Although a detailed configuration is not shown in FIG. 1, when the transfer belt unit 8 is used as a transport belt, a recording sheet can be fed from a left side portion of the housing 2 to the transfer belt unit 8. While the recording sheet is transported on the belt 14 from a left to right direction, the recording sheet receives respective toner images from the photoconductive members 10Y, 10C, 10M, and 10K to form a full-color toner image thereon. The recording sheet is fed to the fusing unit 6 to fix the toner image on the recording sheet, and ejected to the sheet ejection tray 19 provided on an upper surface of the housing 2.

Another embodiment of the present invention is explained with reference to FIG. 5. Like reference numerals in FIGS. 1 to 4 designate identical or corresponding parts in FIG. 5, and therefore explanations of the identical or corresponding parts may be omitted.

Figure 4:
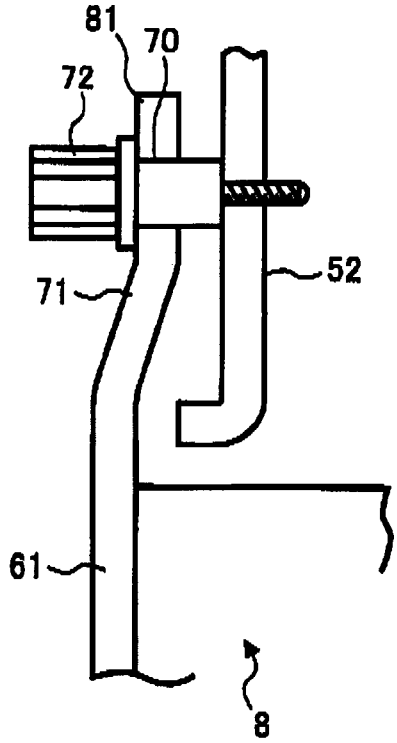
FIG. 4 is a sectional view showing a fixing configuration for fixing an intermediate transfer belt unit to a housing of an image forming apparatus according to the present invention.
Figure 5:
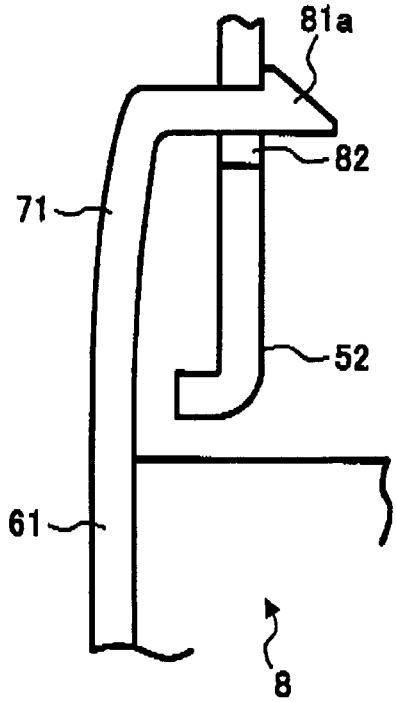
FIG. 5 is a sectional view showing another fixing configuration for fixing an intermediate transfer belt unit to a housing of an image forming apparatus according to the present invention.

Instead of the screw 72 in FIG. 4, a snap-fit tab 81*a* (i.e., locking member) is provided on the front plate 61 for connecting the transfer belt unit 8 to the housing 2 as shown in FIG. 5. The snap-fit tab 81*a* is formed at a free edge of the flexible member 71. The snap-fit tab 81*a* detachably engages with a latching portion 82 formed in the front frame 52 of the housing 2. The transfer belt unit 8 is fixed to the housing 2 by engaging the snap-fit tab 81*a* to the latching portion 82. Such fixing results in flexing of the flexible member 71 toward the front frame 52. As a result of the flexing, the transfer belt unit 8 is biased toward the housing 2. As a result of the biasing, the one end of the roller shaft 65 of the driving support roller 15*a* of the transfer belt unit 8 can securely engage the coupling part 56.

In the above described configuration, the transfer belt unit 8 can be detached from the housing 2 by disengaging the snap-fit tab 81*a* from the latching portion 82. With such configuration, the embodiment of the invention shown in FIG. 5 provides advantages similar to those discussed above with respect to the embodiment of the invention shown in FIG. 4.

Further, the transfer belt unit 8 shown in FIG. 5 does not require the use of a separate fastener (e.g., the screw 72).

Another embodiment of the present invention is explained with reference to FIGS. 6 to 9. For simplicity, illustration of the driving support roller 15*a* is omitted.

Figure 6:
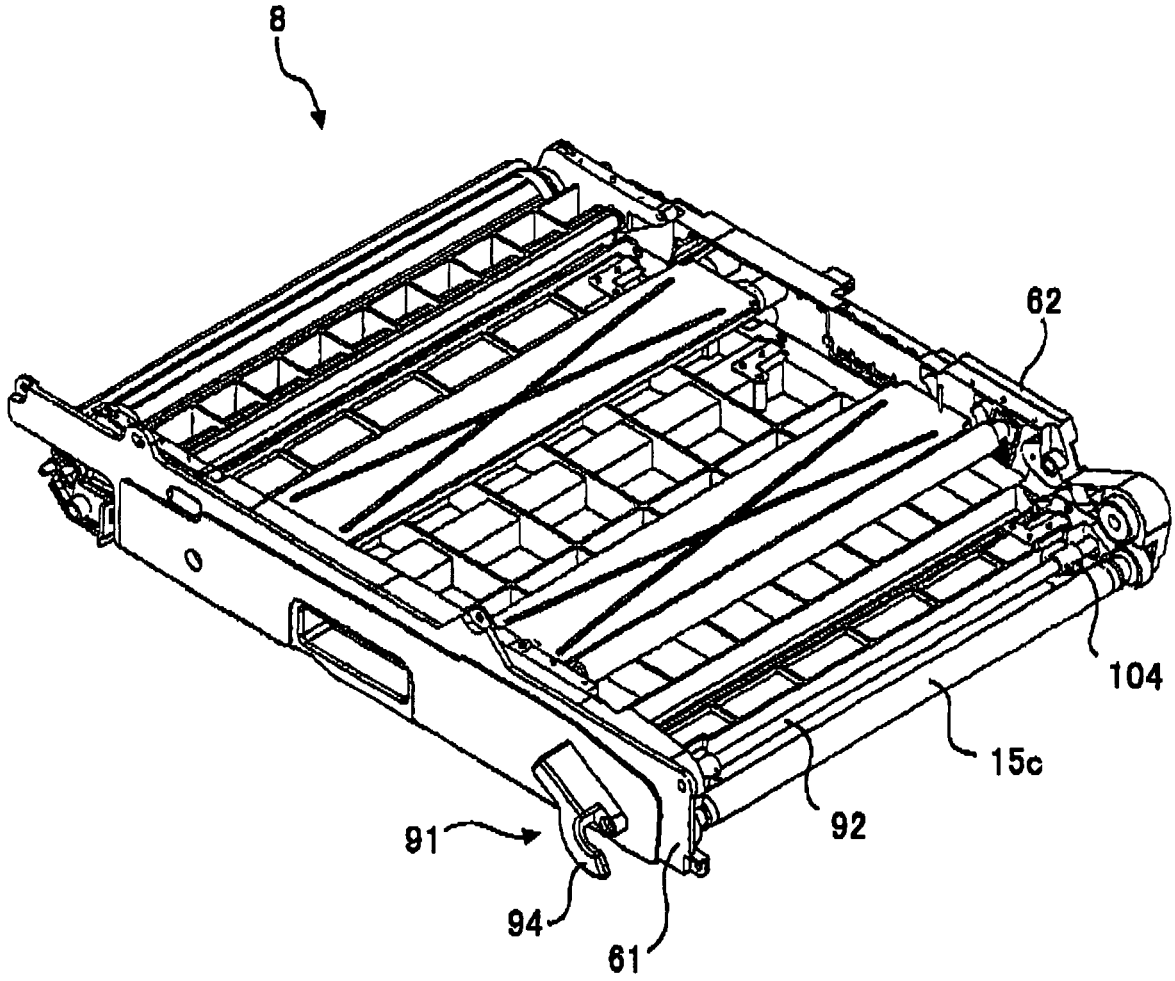
FIG. 6 is a perspective view of another intermediate transfer belt unit according to the present invention.
Figure 7:
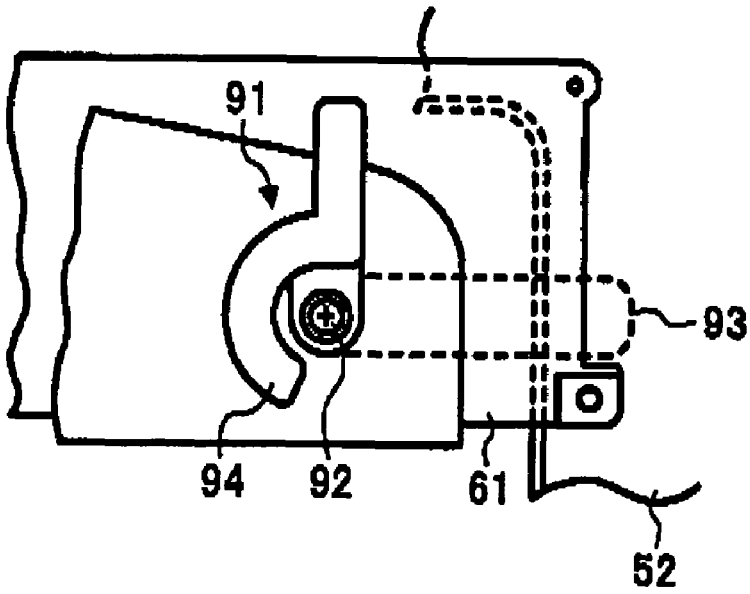
FIG. 7 is a partial view showing another fixing configuration for fixing an intermediate transfer belt unit to a housing of an image forming apparatus according to the present invention.
Figure 8:
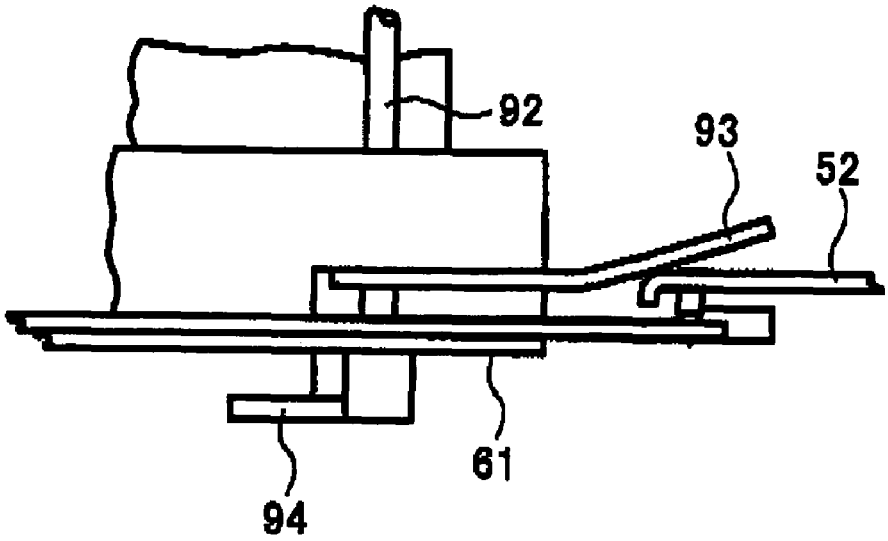
FIG. 8 is another partial view showing the fixing configuration shown in FIG. 7.

As shown in FIGS. 6 to 9, a locking member for fixing the transfer belt unit 8 to the housing 2, one or more of the above described locking members in FIGS. 4 and 5 is provided at one end of the front plate 61. However, a locking mechanism 91 is provided at the other end of front plate 61. As shown in FIGS. 6 to 8, the locking mechanism 91 includes a shaft 92, a leaf spring stopper 93, and a lever 94. The shaft 92 is rotatably supported by the front plate 61 and the rear plate 62. As shown in FIGS. 7 and 8, the leaf spring stopper 93 is a flexible plate fixed to one end portion of the shaft 92. The lever 94 is attached to one end of the shaft 92 protruded from the plate 61. The leaf spring stopper 93 can pivot between a first position and a second position. At the first position, the leaf spring stopper 93 engages with the front plate 61 (FIGS. 7 and 8). At the second position (not shown), the leaf spring stopper 93 does not engage the front plate 61.

When the transfer belt unit 8 is properly positioned in the housing 2, the leaf spring stopper 93 can smoothly pivot from the second position (not shown) to the first position (FIGS. 7 and 8) with an aid of a guide plane (not shown) formed in the front plate 61. By this arrangement, the transfer belt unit 8 is positioned in the housing 2, and then the lever 94 is operated so that the leaf spring stopper 93 is disposed in the first position (FIGS. 7 and 8) to fixedly connect the transfer belt unit 8 to the housing 2. The fixing results in flexing of the leaf spring stopper 93 around a contact point of the leaf spring stopper 93 and the front frame 52, as shown in FIG. 8. As a result of the flexing, the transfer belt unit 8 is biased toward the housing 2. As a result of the biasing, the one end of the roller shaft 65 of the driving support roller 15*a* of the transfer belt unit 8 can securely engage the coupling part 56.

In the above described configuration, the transfer belt unit 8 can be detached from the housing 2 by pivoting the leaf spring stopper 93 to the second position (not shown) through operation of the lever 94. As for the transfer belt unit 8, the primary transfer roller 16K for transferring a black image and the support roller 15*c* are assembled with a bracket 101 to configure a primary transfer roller unit 102 as a whole, as shown in FIGS. 9A and 9B.

The primary transfer roller 16K and the photoconductive member 10K sandwich or are disposed on either side of the intermediate transfer belt 14 at a nip position defined by the primary transfer roller 16K and the photoconductive member 10K. The primary transfer roller unit 102 is pivotably supported by a shaft 103. The primary transfer roller unit 102 is coupled to a pivoting mechanism 104.

Figure 9A:
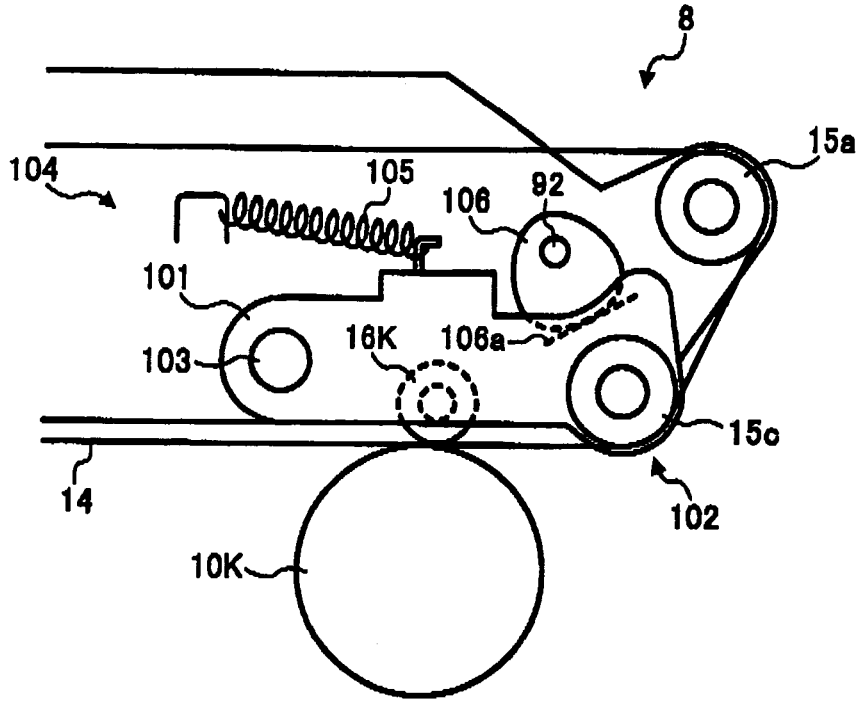
FIG. 9A is a side view of a pivoting mechanism according to the present invention, where a belt contacts a photoconductive member.
Figure 9B:
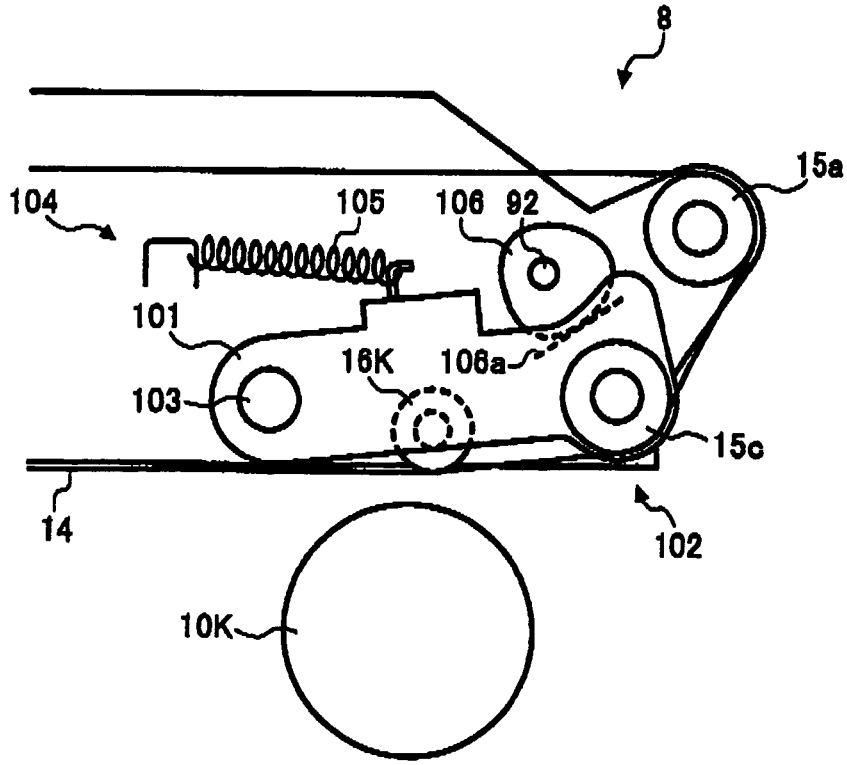
FIG. 9B is a side view of a pivoting mechanism according to the present invention, where a belt does not contact a photoconductive member.

As shown in FIGS. 9A and 9B, the pivoting mechanism 104 includes a coil spring 105, a cam 106, and a cam follower surface 106*a* provided on the bracket 101. The cam 106 connected to the shaft 92 acts to the cam follower surface 106*a*.

FIG. 9A shows a cam configuration in which a relatively large radius of the cam 106 comes into contact with the cam follower surface 106*a* so that the intermediate transfer belt 14 contacts the photoconductive member 10K. FIG. 9B shows a cam configuration in which a relatively small radius of the cam 106 comes into contact with the cam follower surface so that the intermediate transfer belt 14 does contact the photoconductive member 10K.

The coil spring 105 applies a biasing force to the primary transfer roller unit 102 in a direction that the intermediate transfer belt 14 separates from the photoconductive member 10K. When the leaf spring stopper 93 is disposed in the first position (FIGS. 7 and 8) as a result of rotation of the shaft 92 with an operation of the lever 94, the cam 106 contacts the cam follower surface 106*a* at a position illustrated in FIG. 9A so that the primary transfer roller unit 102 pivots to a clockwise direction (i.e., downwardly) against a biasing force of the coil spring 105. By this arrangement, the intermediate transfer belt 14 can contact the photoconductive member 10K, as shown in FIG. 9A.

When the leaf spring stopper 93 is disposed in the second position (not shown) as a result of rotation of the shaft 92 with an operation of the lever 94, the cam 106 contacts the cam follower surface 106*a* at a position illustrated in FIG. 9B so that the primary transfer roller unit 102 pivots counter-clock direction (i.e., upwardly) by a biasing force of the coil spring 105. The intermediate transfer belt 14 can separate from the photoconductive member 10K.

The primary transfer rollers 16Y, 16M, and 16C are driven by another pivoting mechanism (not shown) powered by a driver (not shown) such as a motor so that the primary transfer rollers 16Y, 16M, and 16C contact the photoconductive members 10Y, 10M, and 10C, or separate from the photoconductive members 10Y, 10M, and 10C.

As described above, in the embodiment shown in FIGS. 6 to 9, when the leaf spring stopper 93 is disposed in the first position (FIGS. 7 and 8) to fix the transfer belt unit 8 to the housing 2, a portion of the intermediate transfer belt 14 at the primary transfer roller unit 102 contacts the photoconductive member 10K. When the leaf spring stopper 93 is disposed in the second position (not shown) to detach the transfer belt unit 8 from the housing 2, a portion of the intermediate transfer belt 14 at the primary transfer roller unit 102 separates from the photoconductive member 10K.

During such detachment, the primary transfer rollers 16Y, 16M, and 16C also separate from the photoconductive members 10Y, 10M, and 10C, respectively by the another pivoting mechanism (not shown) powered by the driver. In such a configuration, a contacting or separating operation for the primary transfer roller unit 102 and the intermediate transfer belt 14, and fixing of the transfer belt unit 8 to the housing 2, can be accomplished with a single operation. Therefore, attaching and detaching the transfer belt unit 8 to the housing 2 can be easily accomplished.

Further, when some degree of flexibility is given to the front plate 61 holding the shaft 92 connected to the leaf spring stopper 93, the transfer belt unit 8 can obtain a sufficient flexing effect even if a flexing amount of the leaf spring stopper 93 is relatively small, because a flexing effect of the front plate 61 works in conjunction with a flexing effect of the leaf spring stopper 93.

Another embodiment of the present invention is explained with reference to FIGS. 10 to 12.

Figure 10:
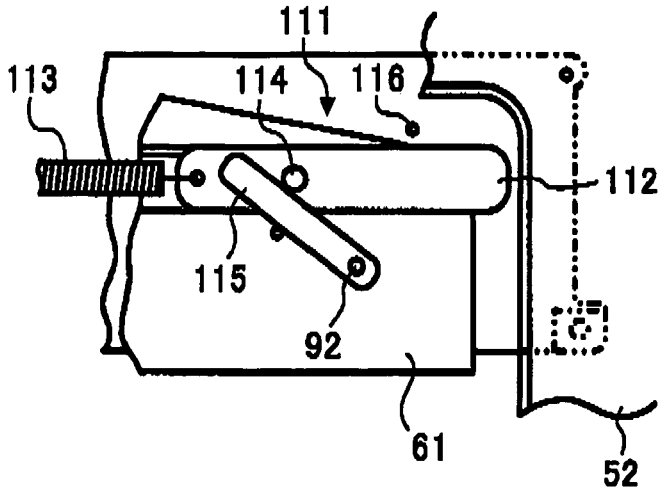
FIG. 10 is a partial view showing another fixing configuration according to the present invention, where an intermediate transfer belt unit is not fixed to a housing of an image forming apparatus.
Figure 11:
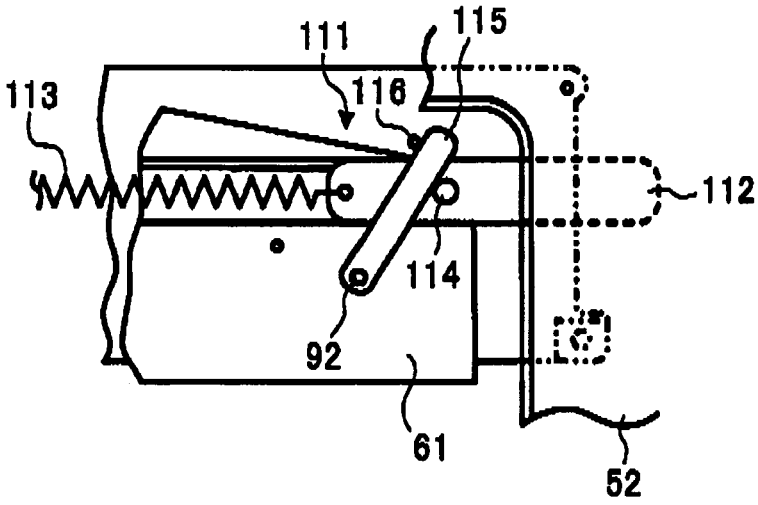
FIG. 11 is a partial view showing another fixing configuration according to the present invention, where an intermediate transfer belt unit is fixed to a housing of an image forming apparatus.
Figure 12:
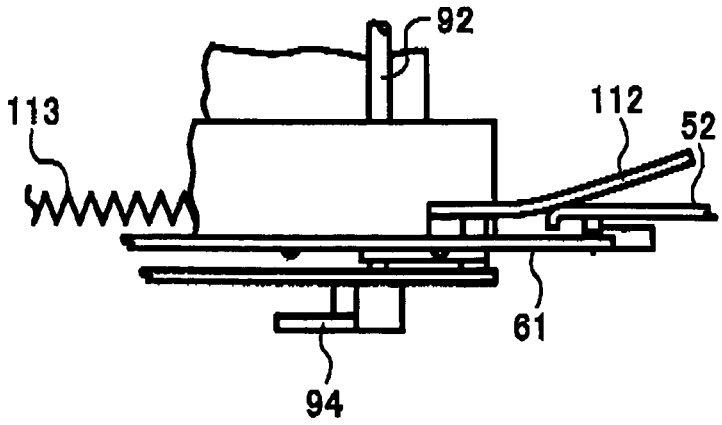
FIG. 12 is a partial view showing the fixing configuration shown in FIG. 11.

Another embodiment, as shown in FIGS. 10 to 12, is provided with a locking mechanism 111 instead of the locking mechanism 91. The locking mechanism 111 includes a leaf spring stopper 112 including a flexible plate and movable to longitudinal directions of the front plate 61.

The leaf spring stopper 112 is movable between a first position and a second position. At the first position, the leaf spring stopper 112 engages with the front frame 52 of the housing 2, as shown in FIGS. 11 and 12. At the second position, the leaf spring stopper 112 does not engage the front frame 52 of the housing 2, as shown in FIG. 10. When the transfer belt unit 8 is properly positioned in the housing 2, the leaf spring stopper 112 moves smoothly from the second position to the first position with an aid of a guide plane (not shown) formed in the front plate 61.

The leaf spring stopper 112 is constantly receiving a biasing force in a direction of the second position from a coil spring 113. As shown in FIGS. 10 and 11, a pin 114 is formed on a surface of the leaf spring stopper 112, and a pivot arm 115 fixed to one end of the shaft 92 contacts the pin 114. By this arrangement, when the lever 94 is operated so that the shaft 92 rotates in the clockwise direction in FIG. 10, the pivot arm 115 pushes the pin 114 and moves the leaf spring stopper 112 located at the second position (FIG. 10) toward the first position (FIGS. 11 and 12).

During such movement, the coil spring 113 applies a biasing force to the leaf spring stopper 112 in the opposite direction of the movement of the leaf spring stopper 112. When the leaf spring stopper 112 is disposed in the first position (FIGS. 11 and 12), the pivot arm 115 passes over an elastic stopper 116 formed on the front plate 61, and is locked by the elastic stopper 116.

At the first position, the leaf spring stopper 112 flexes around a contact point of the leaf spring stopper 112 and the front frame 52, as shown in FIG. 12. As a result of the flexing, the transfer belt unit 8 is biased toward the housing 2.

To unlock the pivot arm 115 from the locked position, the lever 94 is operated to rotate the shaft 92 to the counter-clockwise direction in FIG. 11. The pivot arm 115 pivots to the counter-clockwise direction in FIG. 11, and passes over the elastic stopper 116 to unlock the pivot arm 115 from the locked position.

During unlocking, the leaf spring stopper 112 moves to the second position (FIG. 10) from the first position (FIGS. 11 and 12) by a pivot movement of the pivot arm 115 to a counter-clockwise direction and a biasing force applied by the coil spring 113.

By this arrangement, the embodiment shown in FIGS. 10 to 12 can provide similar advantages as those provided by the embodiment of the invention shown in FIGS. 6 to 9. Further, in the embodiment of the invention shown in FIGS. 10 to 12, the transfer belt unit 8 can be readily detached from the housing 2 because the leaf spring stopper 112 can move from the first position (FIGS. 11 and 12) to the second position (FIG. 10) by utilizing a biasing force of the coil spring 113.

It is to be understood that a plurality of the above-discussed locking members and locking mechanisms can be combined to provide the above described effect of higher precision for the assembly of the transfer belt unit and the housing of the image forming apparatus, and improving assemblability of the transfer belt unit to the image forming apparatus.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications no. 2003-433199, filed on Dec. 26, 2003 in the Japan Patent Office, the entire contents of which is hereby incorporated by reference herein.

What is claimed is:

1. An image forming apparatus, comprising:

a housing;

a transfer belt unit configured to be detachable from the housing, the transfer belt unit comprising:

at least two support rollers;

at least one frame member configured to rotatably support the at least two support rollers and comprising a front frame including a flexible member having a free edge configured to be engaged with the housing;

a belt extended by the at least two support rollers; and a locking member configured to lock the front frame and the housing by coupling the free edge of the flexible member to the housing, said transfer belt unit being detachable from the housing in an axial direction of at least one of said support rollers.

2. The image forming apparatus according to claim 1, wherein the front frame is made from a resinous material.

3. The image forming apparatus according to claim 1, wherein the flexible member is configured to flex when the free edge of the flexible member is coupled to the housing.

4. The image forming apparatus according to claim 1, wherein the locking member comprises a screw configured to couple the transfer belt unit and the housing.

5. The image forming apparatus according to claim 1, further comprising:

at least one image carrying member configured to carry a toner image thereon.

6. The image forming apparatus according to claim 5, wherein the transfer belt unit is configured to receive the toner image from the at least one image carrying member as an intermediate transfer image and to transfer the intermediate transfer image to a recording sheet.

7. The image forming apparatus according to claim 5, wherein the transfer belt unit is configured to transport a recording sheet during receipt of the toner image from the at least one image carrying member.

8. An image forming apparatus, comprising:

means for transferring configured to be detachable from means for housing, the means for transferring comprising:

at least two support rollers;

at least one frame member configured to rotatably support the at least two support rollers and comprising a front frame including a flexible member having a free edge configured to be engaged with the housing;

a belt extended by the at least two support rollers; and a locking member configured to lock the front frame and the means for housing by coupling the free edge of the flexible member to the means for housing, said means for transferring being detachable from said means for housing in an axial direction of at least one of said support rollers.

9. The image forming apparatus according to claim 8, wherein the front frame comprises a resinous material.

10. The image forming apparatus according to claim 8, wherein the flexible member is configured to flex when the free edge of the flexible member is coupled to the means for housing.

11. The image forming apparatus according to claim 8, wherein the locking member comprises a screw configured to couple the means for transferring and the means for housing.

12. The image forming apparatus according to claim 8, further comprising means for carrying a toner image.

13. The image forming apparatus according to claim 12, wherein the means for transferring is configured to receive the toner image from the means for carrying as an intermediate transfer image and to transfer the intermediate transfer image to a recording sheet.

14. The image forming apparatus according to claim 12, wherein the means for transferring is configured to transport a recording sheet during receipt of the toner image from the means for carrying.

15. A method of detachably attaching a transfer belt unit to a housing of an image forming apparatus, comprising:

inserting the transfer belt unit in the housing;

positioning the transfer belt unit in the housing; and locking the transfer belt unit to the housing, wherein the transfer belt unit, comprises:

at least two support rollers;

at least one frame member configured to rotatably support the at least two support rollers and comprising a front frame including a flexible member having a free edge configured to be engaged with the housing;

a belt extended by the at least two support rollers; and a locking member configured to lock the front frame and the housing by coupling the free edge of the flexible member to the housing, said transfer belt unit being detachable from the housing in an axial direction of at least one of said support rollers.

16. The method according to claim 15, wherein the front frame comprises a resinous material.

17. The method according to claim 15, wherein the flexible member is configured to flex when the free edge of the flexible member is coupled to the housing.

18. The method according to claim 15, wherein the locking member comprises a screw configured to couple the transfer belt unit and the housing.

19. The method according to claim 15, wherein the image forming apparatus comprises at least one image carrying member configured to carry a toner image thereon.

20. The method according to claim 19, wherein the transfer belt unit is configured to receive the toner image from the at least one image carrying member as an intermediate transfer image and to transfer the intermediate transfer image to a recording sheet.

21. The method according to claim 19, wherein the transfer belt unit is configured to transport a recording sheet during receipt of the toner image from the at least one image carrying member.

22. A transfer belt unit configured to detachably attach to an image forming apparatus, comprising:

at least two support rollers;

at least one frame member configured to rotatably support the at least two support rollers and comprising a front frame including a flexible member having a free edge configured to be engaged with the housing;

a belt extended by the at least two support rollers, said belt being detachable from the housing in an axial direction of at least one of said support rollers; and a locking member configured to lock the front frame and the housing by coupling the free edge of the flexible member to the housing.

23. The transfer belt unit according to claim 22, wherein the front frame comprises a resinous material.

24. The transfer belt unit according to claim 22, wherein the flexible member is configured to flex when the free edge of the flexible member is coupled to the housing.

25. The transfer belt unit according to claim 22, wherein the locking member comprises a screw configured to couple the transfer belt unit and the housing.

26. The transfer belt unit according to claim 22, wherein the transfer belt unit is configured to receive a toner image from the image forming apparatus as an intermediate transfer image and to transfer the intermediate transfer image to a recording sheet.

27. The transfer belt unit according to claim 22, wherein the transfer belt unit is configured to transport a recording sheet during receipt of a toner image from the image forming apparatus.

* * * * *